US006672002B1

(12) United States Patent
Gumpper

(10) Patent No.: US 6,672,002 B1
(45) Date of Patent: Jan. 6, 2004

(54) PACKAGE FOR TRANSPORTING AND DISPLAYING BUNCHES OF FRESH CUT FLOWERS

(76) Inventor: Marie Gumpper, L'Horloge-17Bis rue Boucicaut, Cannes (FR), 06400

( * ) Notice: Subject to any disclaimer, the term of this patent is extended or adjusted under 35 U.S.C. 154(b) by 0 days.

(21) Appl. No.: 09/830,397

(22) PCT Filed: Oct. 28, 1999

(86) PCT No.: PCT/FR99/02636

§ 371 (c)(1),
(2), (4) Date: Apr. 26, 2001

(87) PCT Pub. No.: WO00/26117

PCT Pub. Date: May 11, 2000

(30) Foreign Application Priority Data

Nov. 2, 1998 (FR) ..... 98 13901

(51) Int. Cl.[7] ..... A47G 7/02; A01G 5/00; B65D 85/50

(52) U.S. Cl. ..... 47/41.01; 47/84; 206/423

(58) Field of Search ..... 47/41.01, 72, 77, 47/84; 229/108, 108.1, 120.011, 120.01; 206/423

(56) References Cited

U.S. PATENT DOCUMENTS

| | | | | | |
|---|---|---|---|---|---|
| 1,270,554 | A | * | 6/1918 | Rubel | 206/423 |
| 2,507,080 | A | * | 5/1950 | Acker et al. | 206/423 |
| 2,830,405 | A | * | 4/1958 | Nydegger | 206/423 |
| 3,734,275 | A | * | 5/1973 | Greene, III | 206/423 |
| 3,924,354 | A | | 12/1975 | Gregoire | |
| 3,973,356 | A | | 8/1976 | Schacht | |
| 4,608,776 | A | * | 9/1986 | Kooy | 312/116 |
| 4,801,014 | A | * | 1/1989 | Meadows | 206/423 |
| 4,863,015 | A | | 9/1989 | Toltzman | |
| 5,038,930 | A | * | 8/1991 | Holtkamp, Jr. | 206/232 |
| 5,379,549 | A | * | 1/1995 | Carcich et al. | 206/423 |

FOREIGN PATENT DOCUMENTS

| | | | | |
|---|---|---|---|---|
| DE | 1 272 215 | | 11/1963 | B65D/81/20 |
| DE | 1 486 356 | | 4/1969 | B65D/81/25 |
| EP | 828661 | * | 9/1999 | B65D/5/02 |
| GB | 2162817 | * | 2/1986 | B65D/5/02 |
| JP | 03191909 | | 8/1991 | A47G/7/06 |
| JP | 404057739 A | * | 2/1992 | 47/84 |
| WO | WO 92/02580 | | 2/1992 | C08K/7/22 |

* cited by examiner

*Primary Examiner*—Son T Nguyen
(74) *Attorney, Agent, or Firm*—Cohen, Pontani, Lieberman & Pavane

(57) ABSTRACT

The technical field of the invention is that of making receptacles, packages, or parcels for living organisms or materials that are sensitive to changes in atmospheric conditions or surroundings, such as cut flowers. The lower portion ($\mathbf{3}_1$) of a funnel-shaped shell overlies and matches the shape of a top portion ($\mathbf{2}_1$) of a vase (2) which has the same funnel shape as the lower portion of the shell.

17 Claims, 9 Drawing Sheets

PACKAGE FOR TRANSPORTING AND DISPLAYING BUNCHES OF FRESH CUT FLOWERS

PRIORITY CLAIM

This is a U.S. national stage of application No. PCT/FR99/02636, filed on Oct. 28, 1999. Priority is claimed from that application and from the following application, Country: France, Application No.: 98/13901, Filed: Nov. 2, 1998.

BACKGROUND OF THE INVENTION

1. Field of Invention

The present invention relates to a package for transporting and displaying bunches of fresh-cut flowers.

The technical field of the invention is that of making containers, packages, or parcels for living organisms or materials sensitive to changes in atmospheric conditions or surroundings, such as cut flowers, foliage, etc.

The main application of the invention is transporting and displaying cut flowers for sale, in particular bunches of fresh roses, while paying due regard to the biological plant element, so as to ensure that customers receive flowers in the best possible state of conservation.

2. Description of Related Art

After being harvested and separated from the remainder of the plant, it is known that in order to finish growing and bloom, cut flowers can rely only on any water that might be given to them and on their own nutritional reserves. Unfortunately, various causes accelerate wilting, and in particular:

Vascular blockage due to callouses forming in the up vessels, usually near the bottom of the cut stem: these callouses are often of fungal or bacterial origin; sometimes the callouses obstructing the conductive vessels are the result of phenolics present in the cells of the stem being oxidized by enzymes released by the plant to heal the injury constituted by being cut. Water can also be prevented from rising up the stem by air penetrating into the stems due to it being left dry for a long time, e.g. during transport.

In any event, the consequence of such vascular obstruction is a lack of water, with the water that is absorbed no longer compensating losses due to transpiration, so the weight of the fresh flower decreases and the flower wilts; with roses, the top end of the stem, i.e. the flowering peduncle, becomes curved into a so-called "bent-neck" shape, particularly if the roses were picked at an early stage of development.

Degradation of protein reserves: because they are consumed by oxidation in cells and because they migrate to other portions of the flower stem, soluble sugars disappear quickly thus stopping the synthesis of proteins; with most flowers, the resulting degradation in protein reserves, or "proteolysis", accelerates from the beginning of blooming: the degraded proteins release amino acids, and then ammonia which is toxic for cells.

Ethylene which is one of the senescence hormones of plants: it is produced naturally by certain species during blooming of their buds and it can also come from the outside (other plants, bulbs, fruit, tomatoes, internal combustion engines, factories, etc.); ethylene accelerates cell-degradation phenomena in sensitive species, even at low concentrations such as 0.5 parts per million (ppm); it causes flowers to wither, with flowers, buds, and leaves dropping off, it causes discoloration, . . . . It is produced auto-catalytically.

Absici acid (ABA) or stress hormone (which might be the cause of ethylene production), triggered by water stress, causes stomatal closure to reduce evapotranspiration, but also correspondingly reduces the lifetime of the flower.

Thus, depending on how plants are transported, stored, and conserved, between being picked and being sold to a consumer, and even depending on how the consumer transports them to the place where they are to be put on display, one or more of the causes of wilting outlined above are accelerated. Further information on this topic can be found in the horticultural journal PHM No. 385 of October 1997 in an article entitled "La conservation des fleurs" [Conserving flowers].

Thus, for example, in present distribution systems and circuits, flowers are generally transported while dry or slightly moistened in waterproof bags or in cotton wool soaked in a conserving agent, however that does not prevent air from penetrating into the stems; in addition, some of the businesses delivering flowers in France or even in Europe do not make use of refrigerated transport means, and flowers are stored in packaging boxes made merely of cardboard, with the flowers being secured rather crudely by hooks passing through the cardboard and by rubber bands; some businesses do indeed include a bag of conserving powder with such shipments, but flowers that have traveled while dry have already suffered vascular blockage.

Supermarkets limit such blockage by transporting flowers in refrigerated trucks and by storing them in buckets filled with water, however they are protected solely by optionally perforated transparent films: thus flowers, which are often pressed together and handled, suffer damage before a customer can select them and put them in a shopping trolley or cart; flowers are then stuck upright in a corner of the cart where they run the risk of falling over and being damaged by other packages transported in the same cart, and in any event they are transported dry; they are left dry until their leaves are stripped off and they are put in a vase full of water at the purchaser's home. In addition to the vascular blockage that then takes place, it should be observed that flowers are generally put on sale close to fruit and vegetables, i.e. specifically when ethylene concentration is at its greatest; since the leaves are not pre-stripped from bunches, that can also encourage the development of bacteria in the water medium.

Thus, although the sellers of bunches of cut flowers often emphasize freshness and quality in order to improve sales, it should be observed that nothing particularly professional is done with regard to plant physiology and thus to conserving bunches and satisfying clients.

Numerous patent applications have been made for improving such transport and storage, and in particular international patent application No. WO 95/09083 describing a "gas-permeable corrugated card packaging system" suitable for extending the time during which fruit, fresh vegetables, and cut flowers can be conserved in a modified and refrigerated atmosphere, thus genuinely providing an improvement over packaging in transparent paper as is done in supermarkets, but not dealing as a whole with the problem posed.

The objects of the present invention are to be able to provide packaging for transporting and displaying bunches of fresh-cut flowers, and combining at least the following conditions:

having due regard for the biological plant element whose wilting is accelerated for the reasons outlined above, by providing protection against physicochemical attack such as heat, cold, damp, drying out, etc.;

having due regard for the biological plant element by providing protection against mechanical attack due to impacts, falling, compression, vibration, etc. throughout the circuit: from the flower producer or grower to the premises of the end consumer;

being practical and useful for the professional:

by facilitating transport, handling, storage, and packaging prior to assembly, in particular by providing a package that can be folded flat so as to save as much space as possible, i.e. a package which can be flat in shape when it is folded; and by providing a package that is easily assembled to receive cut flowers and in which it is easy to package and protect flowers, and also a package which makes it easier to combine a plurality of packages side by side, in particular on a display unit once the package is in the assembled position, in particular containing packaged flowers so as to provide optimum space saving in this condition also;

being practical and useful for the consumer by facilitating transport, handling, and use without special preparation, once the package has been assembled and used for receiving flowers, while also ensuring the best possible conservation of the plant, from the business that made up of the bunch to the end user's home;

providing a package which enables the consumer to transform said package into a vase without damaging the flowers;

being attractive in appearance and drawing the attention of clients who need to be motivated to purchase bunches packaged in this way, whether for their own use or as gifts, while also enabling the package to be personalized so as to carry any message desired by the vendor; and being as low in cost as possible so as to avoid increasing the cost of the bunch.

BRIEF SUMMARY OF THE INVENTION

For this purpose, the present invention provides a package for bunches of fresh-cut flowers, which package has a quasi-rigid shell surrounding at least the flowering ends of said flowers.

The package of the invention comprises a leakproof and rigid vase suitable for containing a liquid or gel for keeping the cut ends of the stems of said flowers hydrated, and said shell comprises at least, firstly a funnel-shaped portion whose lower portion co-operates with the upper portion of the vase via preferably-reversible connection means and whose upper portion surrounds the flowering ends of said flowers, and secondly a cover for protecting said flowering ends, which cover closes the large base of the upper portion of the funnel-shaped shell, and said shell includes in its said upper portion at least one lateral opening/closing means.

Said connection means enable said shell to be connected to and removed from said vase. These means are preferably reversible, i.e. they enable the shell to be reconnected to the vase after it has been disconnected.

The lateral opening means enable the bunch of flowers to be removed while avoiding any rubbing against the shell which is one of the major sources of damage to flowers, giving rise to an ethylene crisis that leads to early senescence of the plant.

The liquid can be absorbed by a solid substrate contained in the vase, such as a block of foam; the bottom ends of the flower stems can be stuck into the substrate, in particular while the bunch is being transported in the package.

In an advantageous embodiment, the lower portion of the funnel-shaped shell overlies and matches the shape of an upper portion of the vase, which upper portion has the same funnel shape as said lower portion of the shell. In particular, the small base of the funnel-shaped lower portion of the shell is smaller than the opening of the top portion of the vase. This juxtaposition of the lower portion of the shell and the top portion of the vase provides a stable connection between said shell and said vase.

Advantageously, said shell is constituted by a precut and non-stuck sheet having non-parallel longitudinal first fold lines suitable for obtaining a funnel shape of polygonal section after folding and, where appropriate, enabling said lateral opening means of said shell to be used.

In a particular embodiment, said lateral opening/closing means of said shell are constituted by hook and notch shaped cutouts on the side edges in the upper portion of the shell located above the vase. These lateral opening/closing means enable said shell sheet to be looped, in particular after folding and wrapping around flowers placed in said vase, and they also enable said shell to be opened. At the consumer's home, the shell is released via said hooks or notches, thereby releasing the vase and enabling it to be filled with water.

Advantageously, in its upper portion said vase has hooking means or openings suitable for co-operating respectively with openings or hooking means in said lower portion of said shell so as to constitute the connection means between said shell and said vase.

In a variant embodiment, said connection means between the shell and the vase are constituted by openings in the lower portion of the shell along said non-parallel first fold lines of the shell, and projecting elements at the corners of the upper portion of the vase in the form of a polygonal funnel, said projecting elements penetrating into said openings of the shell after the-shell has been folded around the vase and said lateral closing means of said shell have been operated.

In an embodiment of this variant, said projecting elements are constituted by the corners of a top parallelepipedal portion of said vase situated above said funnel-shaped upper portion of said vase and constituting the opening of said vase.

In another variant embodiment, said shell has an upper portion constituting an upper funnel and a lower portion constituting a lower funnel, the sides of the upper funnel sloping relative to the central axis of the funnel at an angle that is smaller than the angle at which the sides of the lower funnel slope relative to the same central axis of the funnels, said lower funnel of the shell overlying a said funnel-shaped upper portion of the vase.

In the two above embodiments, good complementarity and good co-operation are obtained between the shell and the vase to provide better cohesion to the assembly after it has been joined together, enabling it to withstand manipulation during transport better.

According to another characteristic of the invention, said cover is constituted by cutting out one or more zones at the top end of the sheet constituting said shell and enabling the top opening of the upper funnel of said shell to be closed after folding.

According to another characteristic, said sheet constituting said shell has one or more zones at its top end suitable for constituting a handle after folding.

According to another particular characteristic, said vase is constituted by a sheet having parallel longitudinal first fold lines enabling the following to be formed by folding from top to bottom:

a top opening of the vase;

an upper first funnel-shaped portion of polygonal section with the sides of the polygon narrowing downwards, the small base of said upper funnel being preferably at a height lying between one-half and four-fifths of the height of the vase;

a lower second funnel-shaped portion of polygonal section with the sides of the polygon of said polygonal section widening downwards;

a bottom constituting a flat bottom for the vase; and said bottom and said top opening of the vase thus having the same polygonal shape, the polygon in particular having three to six sides and most preferably being a regular polygon.

In a variant embodiment, said vase has a top first parallelepipedal portion defined by fold lines perpendicular to said parallel fold lines of said vase, situated above said upper funnel-shaped portion and constituting the top opening of the vase.

In an embodiment, said vase has a second parallelepipedal portion corresponding to the lower portion of said vase and defined by fold lines perpendicular to said fold lines, situated beneath said lower second funnel-shaped portion, and including the bottom of said vase.

Advantageously, the precut sheet constituting said vase has cutouts and openings forming four flaps in its lower portion that are suitable for forming said flat bottom of the vase after folding and/or sticking.

The package of the present invention is made up of two portions respectively constituting a shell and a vase, said shell and vase being suitable for being folded into flat shapes prior to use.

In particular embodiments, said cover has a transport handle and its outside shape is a polygon, in particular it is square or hexagonal in shape.

In order to facilitate storage and transport of said bunches of flowers, the package of the invention is preferably of a regular symmetrical shape about a vertical axis, and can be installed on a support having a stand with sockets of an inside shape that co-operates with the outside shape of the lower portion of a vase, and with the axes of said shells, corresponding to the axes of the packages, being disposed relative to one another and in particular in groups of at least three by three, at distances equal to the diameter of the inscribed circle that is tangential to the outside shape of the covers of said packages: thus, particularly if the covers of the packages are polygons having three, four, or six sides, they bear against one another and interfit against one another like a mosaic; this ensures that they are properly secured not only via their bottoms because the vases are held in the sockets of the stand, but also via the large bases of their funnel-shaped upper portions which are held against one another.

The present invention thus also provides a display and packaging unit for the packages of the invention comprising a stand having sockets of inside shape suitable for co-operating with the outside shape at the bottoms of said vases, and with said sockets being disposed relative to one another in such a manner that the sides of the covers of the various adjacent packages whose vases are inserted in said sockets come to bear against one another.

In addition, the flared shape of the shell leaves room for cold air to circulate during transport and storage in refrigerated cells: the ideal temperature for conserving flowers (except for tropical flowers such as orchids) lies in the range 2° C. to 5° C., thereby slowing down the metabolic process of aging and limiting evaporation of water via the stomata; this also serves to avoid temperature differences which can give rise to condensation on the flowers, thereby encouraging the development of Botrytis. The package of the invention when used as from the pre-refrigeration cell, thus makes it possible to avoid breaking the cold chain, and the vase integrated in the package makes it possible to keep the cut ends of the stems in a liquid or a gel, thus avoiding dry transport.

The vase can be made of card, preferably card that presents qualities of mechanical resistance to moisture and provided with a leakproof inner lining, in particular one made of polyethylene, that is preferably suitable for retaining the water that is poured into said vase.

The vase of the invention makes it possible to add an antiseptic into the aqueous medium together with an acid agent and also to avoid water stress by encouraging the flow of raw sap in the xylem and elaborated sap (the product of photosynthesis) in the phloem. In addition, once the funnel-shaped portion and the cover have been removed, such a vase can allow a user to put the flowers on display immediately without any need to find some other vase, and without causing the plant to suffer.

The shape of the shell makes it possible to protect buds, petals, leaves, and stems not only from handling but also from any mechanical impact during transport and in the shop; this shape matches the volume occupied by leaves and buds from the bottoms of leafy stems to their flowering ends; it can be transparent and ribbed or perforated or corrugated, allowing air to flow downwards so as to avoid the development of Botrytis. Since the flowers are transported in a pre-refrigerated state and in the dark, their metabolisms run slowly, on their own reserves, and the package of the invention prevents them from being disturbed or degraded by the environment.

In terms of gas, the package must be porous, at least via the cover, and as a priority from the inside towards the outside so as to protect the flowers from external gases, such as cigarette smoke, exhaust fumes, nearby fruits and vegetables, while nevertheless allowing the plants to breathe. For example, with a non-climateric flower such as a rose, i.e. a flower that does not produce its own ethylene, certain cultivars are nevertheless sensitive to external ethylene. The cover is rigid and can be transparent like the shell, so that the customer can see what is being bought.

The cover also makes it possible:

to close the package to protect the most delicate portion of the flower, i.e. its bud;

to carry the bunch in its package by means of an integral handle;

to hold packages against one another via their tops during transport because of their touching polygonal shape; and to allow the plants to breathe while protecting them from harmful external gases.

The result is a novel type of package for bunches of fresh-cut flowers such as roses, that has regard for the biological plant element: the present invention improves quality by providing a solution to the need to preserve the plant and by contributing to the overall quality actions undertaken by horticultural professionals, from the grower to the distributor; the present invention is thus not only a package.

Other advantages of the present invention can also be mentioned, however those mentioned above suffice to show and demonstrate the novelty and the advantage of the invention.

BRIEF DESCRIPTION OF THE DRAWINGS

The description and the accompanying figures show embodiments of the invention that have no limiting character: other embodiments are possible in the ambit of the scope and the extent of the invention, in particular by changing the ways in which the various portions constituting said package are made.

FIGS. 1 to 3 show a first embodiment.

FIG. 1 is a perspective view of an embodiment of a package in accordance with the invention.

FIG. 3 is a diagrammatic perspective view of a display unit that can also be used for transporting packages of the invention on stands.

FIGS. 4 and 7 show shell-constituting sheets in the flat state.

FIGS. 5 and 8 show vase-constituting sheets in the flat state.

FIGS. 6 and 9 show the packages of embodiments 2 and 3.

FIGS. 7 to 9 show a third embodiment.

DETAILED DESCRIPTION OF THE PRESENTLY PREFERRED EMBODIMENT

Embodiment 1 (FIGS. 1 to 4)

Figure 1:
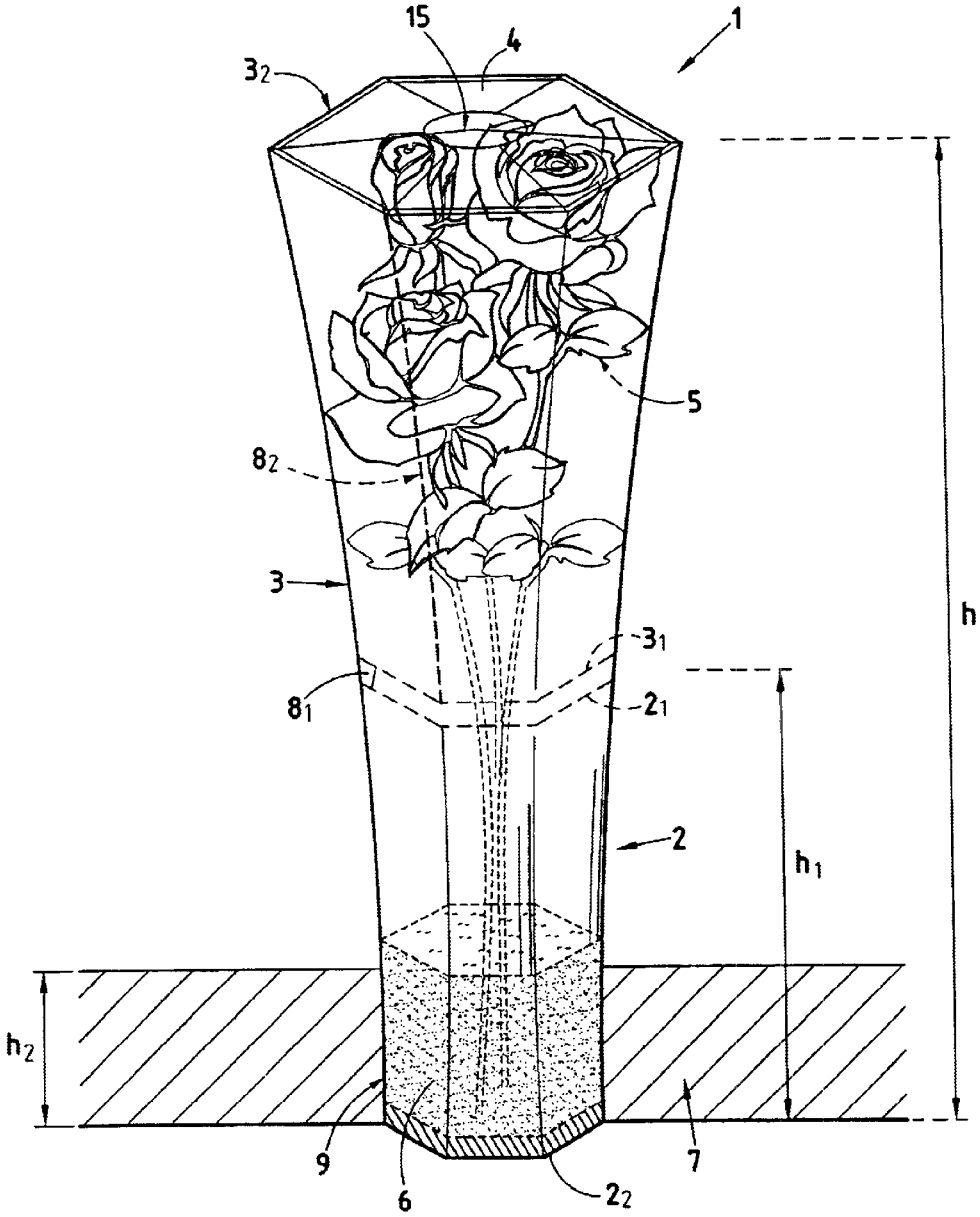

In conventional manner, the package 1 comprises a practically rigid funnel-shaped shell 3 surrounding at least the flowering ends of fresh-cut flowers 5; in addition, in the invention, the package includes a leakproof vase 2 that is rigid and flat-bottomed, containing a liquid or gel suitable for keeping the cut ends of said flowers in an aqueous medium, preferably including a bactericide: its total height $h_1$ can, for example, be 25 centimeters (cm) for flowers such as roses that are 50 cm high and its inside diameter can lie in the range 6 cm to 10 cm, given that the stems of the flowers 5 are preferably held together in said vase 2 by binding at the top of the leafy portions of the stems.

The diameter of said vase 2, and also its height $h_1$, are defined in such a manner as to provide physical support to the stems supporting the weight of buds and flowers, and to do so as a function of the length of the stems; it can be round or polygonal in shape, for example it can be hexagonal like the top cover 4 of the package 1: it must be leakproof and it can be made of a rigid plastics material that is transparent or opaque, such as polystyrene, leakproofed card, or metal, etc. Its weight should be determined so as to ensure that the bunch of flowers 5 is properly balanced and can stand vertically on its own. Thus, the bottom $\mathbf{2}_2$ of said vase can be weighted depending on the materials used so that, for height $h_1$ equal to 25 cm, receiving twenty flowers such as roses that are 50 cm high, weighing a total of 400 grams (g), and receiving, for example a volume 6 of 200 milliliters (ml) water with bactericide.

In FIG. 1, said shell 3 which is thus likewise rigid, comprises at least a funnel-shaped portion that diverges upwards in the flower transport, storage, and presentation position, and in which the shape of its bottom small base $\mathbf{3}_1$ corresponds to the shape of the open top portion $\mathbf{2}_1$ of the vase 2, while the shape of its large base situated at the top surrounds the flowering ends of said flowers 5: its inside dimensions must be about 2 cm greater than those of the bunch of flowers 5 that is received and protected therein.

Said shell 3 also comprises a rigid top cover 4 for protecting said flowering ends; said cover 4 is porous, as can also be the shell 3, essentially from the inside towards the outside of the volume of the package, and it closes the large base $\mathbf{3}_2$ of the top portion of the funnel-shaped shell 3.

It is preferably provided with a carrying handle 15 represented merely by a line in FIG. 1, and that must enable a customer to pick up the entire package whose weight in the present example is about 700 g, for a package having a total height h of 52 cm. The shell 3 is preferably of regular and symmetrical shape about a vertical axis.

Figure 2A:
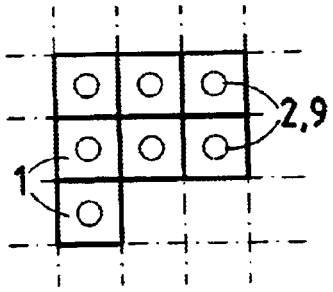
FIGS. 2A, 2B, 2C, 2D, and 2E are simplified plan views of a package assembly of the invention in which the covers and top portions are of various regular polygonal shapes and disposed vertically in the sockets of a common stand.
Figure 2B:
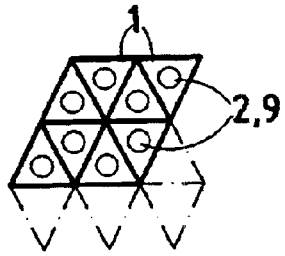
Figure 2C:
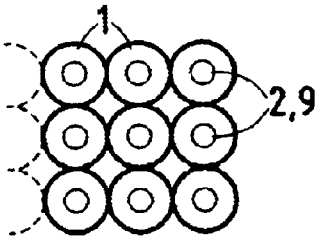
Figure 2D:
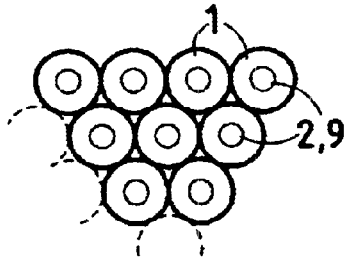
Figure 2E:
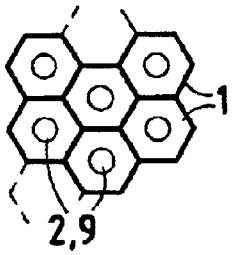
Figure 3:
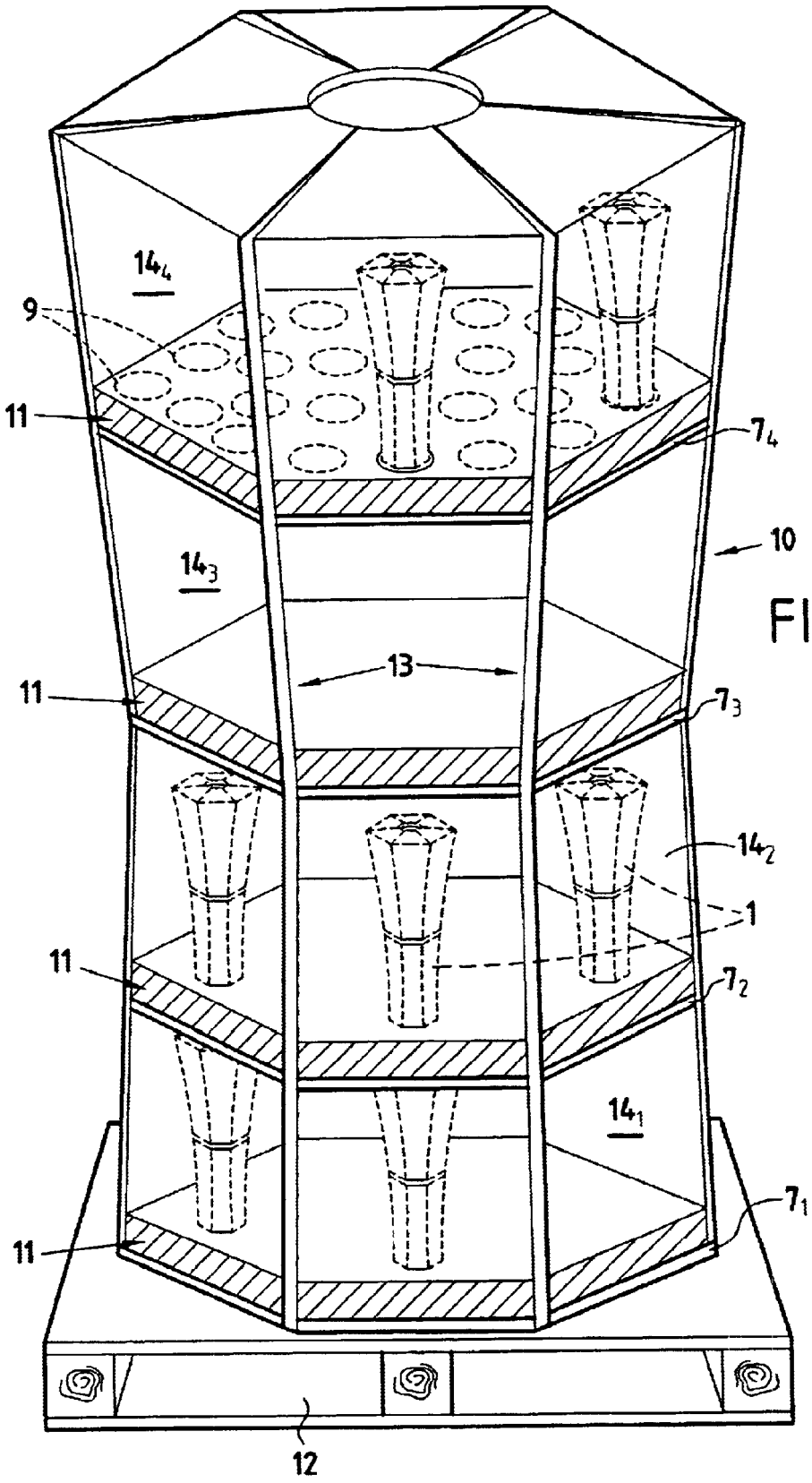

In order to enable said packages to be transported while paying proper regard to the biological plant element, the packages are associated in FIG. 3 with a common stand 7 for a plurality of packages, the stand having sockets 9 of inside shape that co-operates with the outside shape of the vase 2 of each package, the axes of said sockets 9 being placed at least in threes at distances apart equal to the diameter of the inscribed circle that is tangential to the outside shape of the cover 4. The cover is in the form of a polygon having no more than six sides and is preferably hexagonal, thus enabling each package 1 to bear against six other packages adjacent thereto, as shown in FIG. 2E, each vertex of the cover hexagon being common to three adjacent packages. The cover could also be square in shape as shown in FIG. 2A, triangular as shown in FIG. 2B, or merely circular as shown in FIGS. 2C and 2D. In these various figures, where all of the packages are shown as seen from above, the positions of the vases 2 received in the sockets 9 of the stand 7 can also be seen.

Said stand 7 can be made of compacted polystyrene or of card or of rigid plastics material and it is preferably of the same size as the loading trays used by transport equipment, i.e. for example, 124 cm×53.5 cm: its height $h_2$ is at most 8 cm and can be smaller, depending on the stability of the packaging assembly comprising the cover 4, the shell 3, and the vase 2, when containing the water 6 and the flowers 5.

These stands 7 can be put on the support shelves 11 of a display unit 10 as shown in FIG. 3, serving firstly to transport the packages 1 by means of a bottom slab 12 made in the same manner as or comprising a standard pallet, i.e. having dimensions of 100 cm×120 cm or 80 cm×80 cm, and also enabling them to be sold in a shop, without any need to move the packages individually; such a display unit which thus also serves as transport packaging, can be made of wood, and it can be dismountable so as to be optionally recovered and reused; its height can be about 180 cm to 190 cm and it can have vertical uprights 13 with three shelves 11 being fixed thereto, for example, thereby defining four loading levels enabling packages to be stored at various heights (42 cm, 52 cm, 62 cm, or 72 cm, depending on the size of the flowers ordered).

The outside shape of the display unit can recall that of the packages 1, i.e. it can have a flared top portion like the funnels 5 of the packages 1, of identical horizontal section, e.g. hexagonal, as shown in FIG. 3 for packages 1 that are likewise hexagonal. The bottom portion of the display unit 1 also flares downwards and forms a relatively narrow waist at the level of the middle shelf 11 so as to provide good stability and a larger storage area for packages 1, which the consumer can take hold of via openings 14 made available between the uprights 13. Such "diabolo-shaped" display units can be transported on refrigerated articulated trucks capable of receiving 48 units when the supporting pallets 12 are 80 cm×80 cm, or 26 units when the pallets 12 are 100 cm×120 cm.

Said package comprises the shell 3 and the cover 4 and it also includes at least one lateral opening $\mathbf{8}_2$ and removable link means $\mathbf{8}_1$ between the bottom $\mathbf{3}_1$ of the funnel and the top portion $\mathbf{2}_1$ of the vase 2: the package then comprises two portions, two materials, and two openings: the funnel 5 and the cover 4 with its handle constituting a kind of ruff in the form of a flat mushroom with a lateral opening $\mathbf{8}_2$; and the link means $\mathbf{8}_1$ can be an adhesive strip, for example. This embodiment needs two opening systems, a top system for installing the flowers in the vase 2 during packaging, and a system that the client can use at home to remove the packaging 3 easily from the vase 2 by opening the lateral opening $\mathbf{8}_2$ and the link means $\mathbf{8}_1$.

Figure 4:
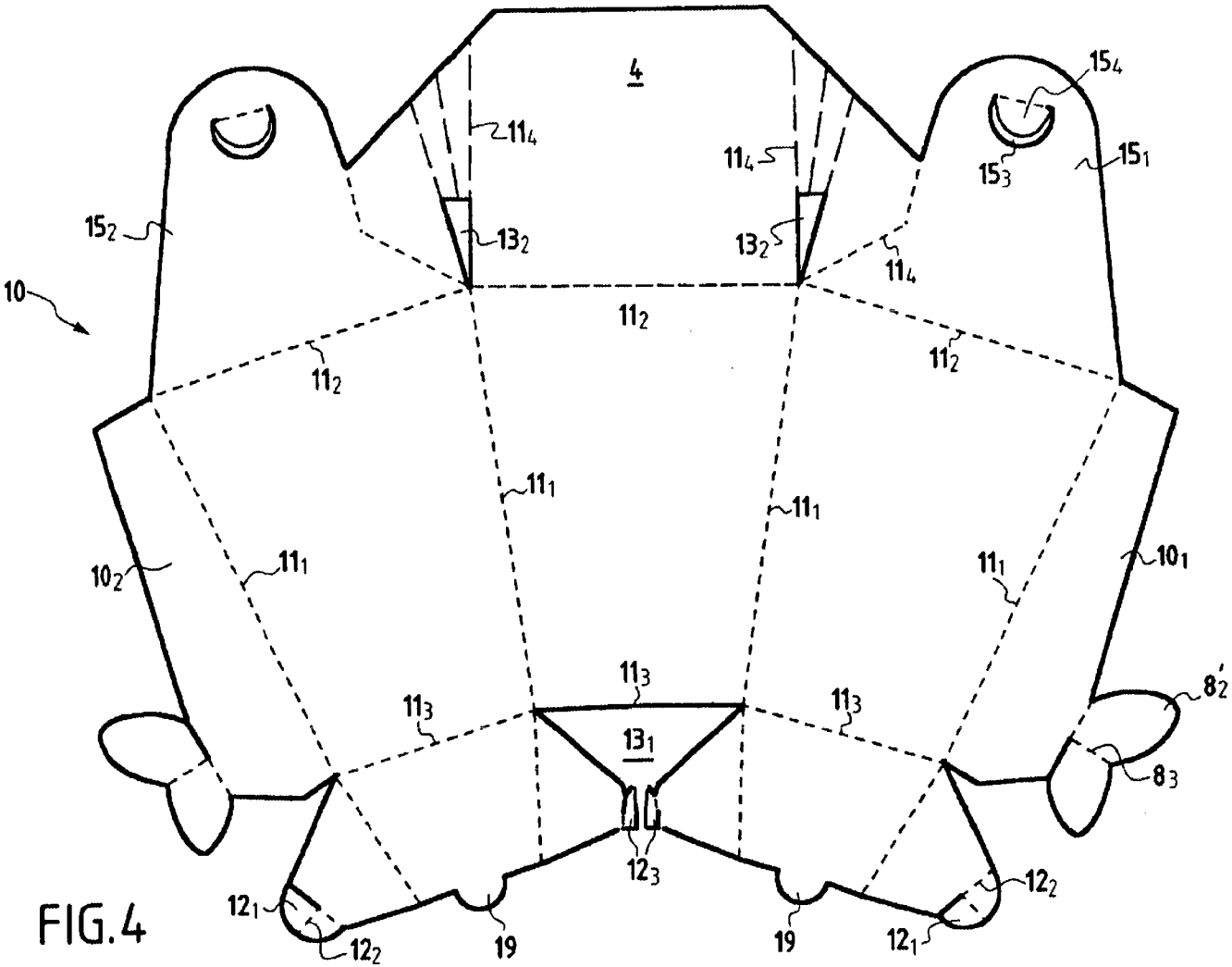
FIGS. 4 to 6 show a second embodiment of the invention.
Figure 5:
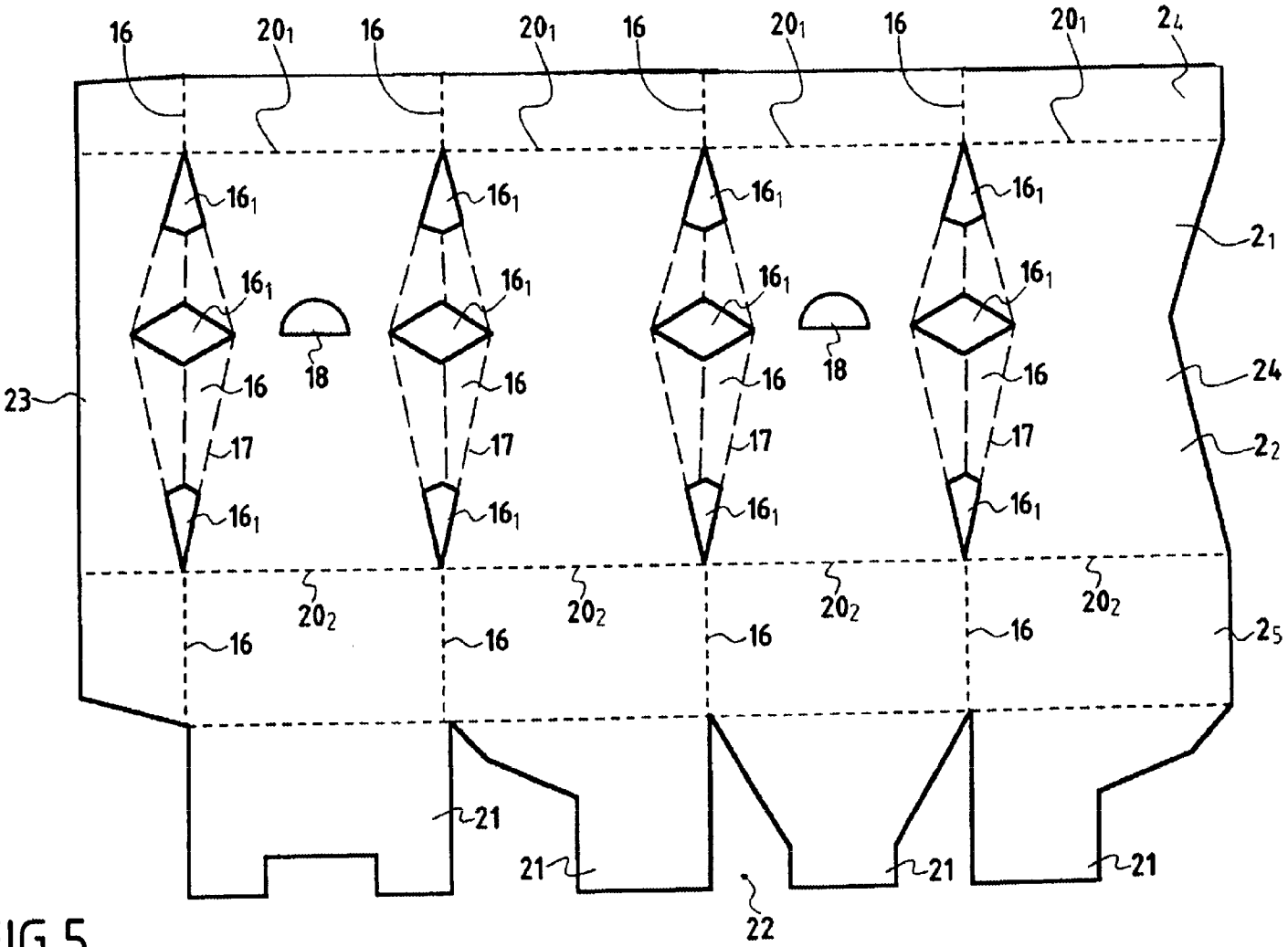
Figure 6:
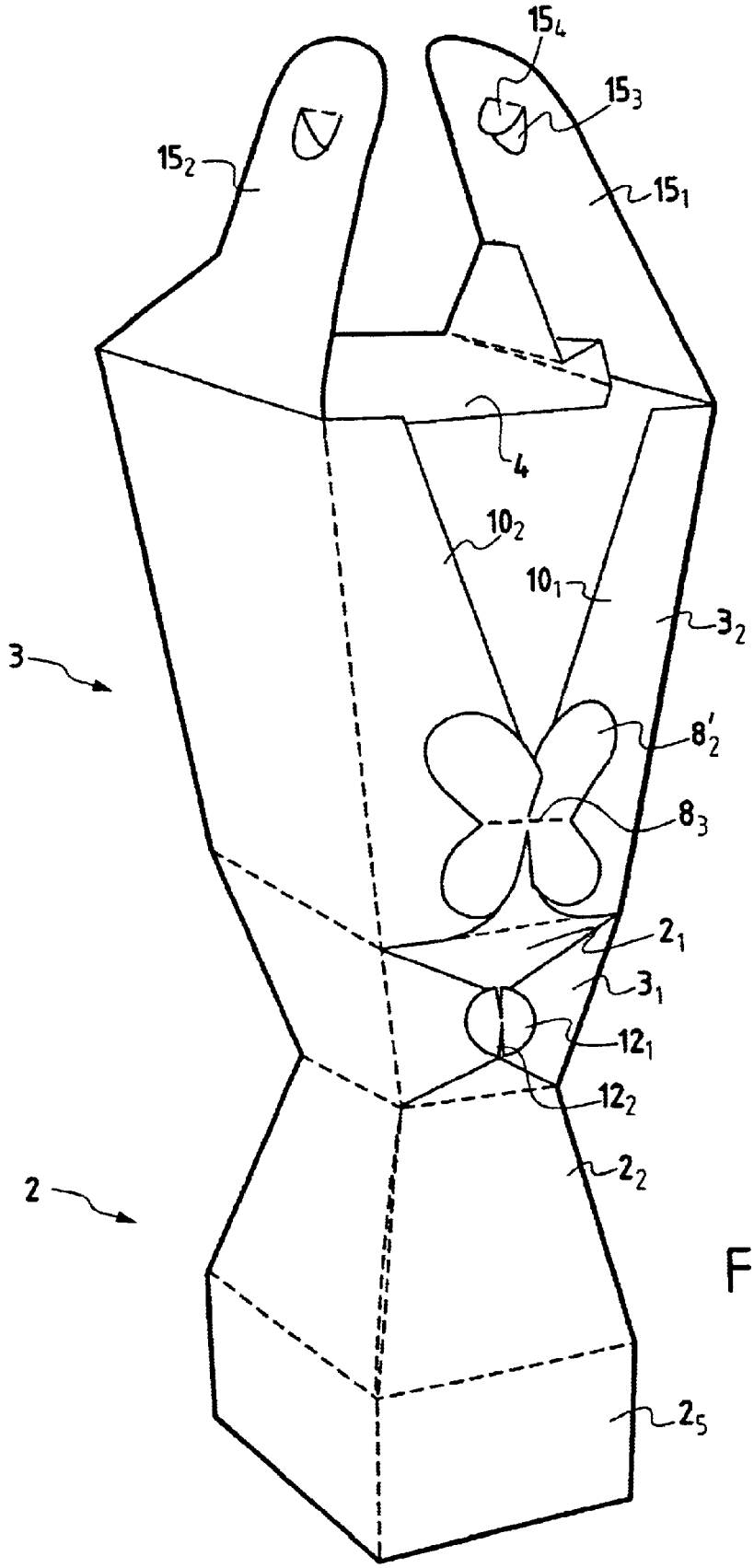

Embodiment 2 (FIGS. 4 to 6)

FIGS. 4 to 6 show a second embodiment as described below.

The shell 3 is made up of a precut sheet 10 without using adhesive, the sheet being made of transparent plastics material and having non-parallel first longitudinal fold lines $\mathbf{11}_1$ so as to be suitable for obtaining a funnel shape of polygonal section after folding and implementing said side closure means $\mathbf{8}_3$ of said shell. Said sheet has cutouts on its side edges $\mathbf{10}_1$ and $\mathbf{10}_2$ in the upper portion $\mathbf{3}_2$ of the shell situated above the vase, which cutouts are butterfly-shaped tabs or hooks $\mathbf{8}_2$ and/or notch $\mathbf{8}_3$ shaped so as to form means for closing said shell sheet in a loop and for opening said shell.

In FIGS. 4 and 6, the shell has an upper portion $\mathbf{3}_2$ constituting an upper funnel, and a lower portion $\mathbf{3}_1$ constituting a lower funnel, with the sides of the upper funnel $\mathbf{3}_2$ sloping relative to the central axis of the funnel at an angle that is smaller than the angle at which the sides of the lower funnel $\mathbf{3}_1$ slope relative to the same central axis of the funnels, the lower funnel $\mathbf{3}_1$ overlying a top portion $\mathbf{2}_1$ of a funnel-shaped vase.

More precisely, the precut sheet 10 constituting the shell has second fold lines $\mathbf{11}_3$ perpendicular to said non-parallel first fold lines, said second fold lines marking the boundary between said upper and lower portions $\mathbf{3}_2$ and $\mathbf{3}_1$ of the shell, and said lower portion $\mathbf{3}_1$ of the shell has openings $\mathbf{13}_1$ along said first and second fold lines or bellows obtained by fold lines that are not parallel to said first and second fold lines, along and around them, so as to enable a lower funnel $\mathbf{3}_1$ to be made by folding at an angle of inclination that is greater than that of the upper funnel $\mathbf{3}_2$ of said shell.

The vase is made of a flat cutout blank shaped like a folding case by means of an adhesive tab: it has at least four main faces. This element is made of card and its top is open to allow the flower stems to pass through.

This vase element has the peculiarity of narrowing at a point up its height (at about two-thirds of its height) so as to provide a waist around which the top shell can be installed and secured.

To make this waist (this narrow section in the case at two-thirds height), the following arrangements are used in the blank.

The vase is made up of a sheet that is precut and preshaped at its side ends 23, 24 which are placed one against the other and which comprise:

parallel first longitudinal fold lines 16 enabling a bottom to be formed constituting the flat bottom of the vase and a top opening of the vase corresponding to the top end of the vase, said bottom and said top opening of the vase thus both having the same polygonal shape; and openings $\mathbf{16}_1$ along and around said first fold lines 16 and/or bellows obtained by second fold lines 17 that are not parallel to said first fold lines, so as to enable the shape of the vase to be narrowed so that it takes up a funnel shape, with the smallest polygonal section of said vase as made in this way being situated at a height that lies between one-half and two-thirds the height of the vase.

The lozenge-shaped openings $\mathbf{16}_1$ are completely emptied or they retain card flaps defined by alternating cuts enabling bellows type folding to be performed at each corner. When the vase is shaped, the lozenge-shaped bellows are pushed into the inside of the case, thereby giving rise to narrowing at a middle fold between the lozenges, thus making it possible to obtain a case having a section that is narrower than that of its top opening.

At the bottom of its funnel-shaped top portion $\mathbf{2}_1$, the vase has openings or notches 18 suitable for co-operating with respective tabs 19 on the lower portion $\mathbf{3}_1$ of said shell, to contribute to uniting said shell and said vase when said tabs 19 are inserted into said openings or notches 18.

The means that connect said shell to said vase comprise hooks $\mathbf{12}_1$, and recesses or notches $\mathbf{12}_2$ formed by cutouts on the side edges of the sheet 10 constituting said shell, in the lower portion $\mathbf{3}_1$ of said shell where it overlies the funnel-shaped upper portion $\mathbf{2}_1$ of said vase, which hooks $\mathbf{12}_1$ and/or notches $\mathbf{12}_2$ co-operate so as to enable said shell sheet to be looped and fitted around the upper portion $\mathbf{2}_1$ of the vase after the shell has been folded and wrapped around said upper portion $\mathbf{2}_1$ of said vase.

The vase thus comprises:

a top first parallelepipedal zone $\mathbf{2}_4$ defined by the fold lines $\mathbf{20}_1$ perpendicular to said first fold lines 16 of said vase;

an upper funnel-shaped portion $\mathbf{2}_1$ of polygonal section with the sides of the polygon narrowing downwards, the small vase of said upper funnel $\mathbf{2}_1$ of the vase lying preferably at a height in the range one-half to two-thirds the height of the vase;

a third portion $\mathbf{2}_2$ in the form of a lower funnel of polygonal section, with the sides of said polygon of said polygonal section widening going downwards; and a second parallelepipedal portion $\mathbf{2}_5$ corresponding to the bottom portion of said vase and defined by fold lines $\mathbf{20}_2$ perpendicular to said first fold lines 16.

The precut blank constituting said vase has cutouts and openings 22 in its bottom portion $\mathbf{2}_4$ so as to form four flaps 21 that make up the flat bottom of the vase after folding or sticking.

In order to put the blank of the shell 3 into place around the vase 2, a first step consists in mutually engaging the two hooks $\mathbf{12}_3$ situated in the lower portion of the shell on its rear face, thereby forming a panel that is to be contiguous with one of the four planes above the waist of the vase. Two other side panels situated in the lower portion of the shell and provided with said semicircular tabs 19 which are inserted in said corresponding openings 18 located at the narrowest portion of the waist of the vase thus serve to prevent the shell from moving down relative to the vase.

Once these three sides have been wrapped in this way around the vase, a fourth side is put into place and secured to the fourth face of the vase by co-operation between two hooks $\mathbf{12}_1$ and $\mathbf{12}_2$, thereby completing closure of the shell around the upper portion of the vase.

In order to unite the large sides of the funnel-shaped shell made by the non-parallel folds $\mathbf{11}_1$, the end walls of the shell $\mathbf{10}_1$, $\mathbf{10}_2$ are moved towards each other and they are linked together by butterfly-shaped tabs $\mathbf{8}_2$, $\mathbf{8}_3$ with each wing engaging in the corresponding wing of the other panel, each wing $\mathbf{8}_2$ engaging in the corresponding wing $\mathbf{8}_3$ of the other panel.

The cover 4 is constituted by a cutout or zone defined by notches or openings $\mathbf{13}_2$ and third fold lines $\mathbf{11}_2$, said cutout or zone being formed at the top end of the sheet constituting said shell and enabling the top opening of the upper funnel $\mathbf{3}_2$ of said shell to be closed after folding.

The sheet constituting said shell has two zones $15_1$ and $15_2$ at its top end that are defined by fold lines $11_2$ and $11_4$ including hooks $15_4$ and notches $15_3$ which make it possible after said zones have been folded one against the other to constitute a handle by co-operation between said hooks and notches.

Figure 7:
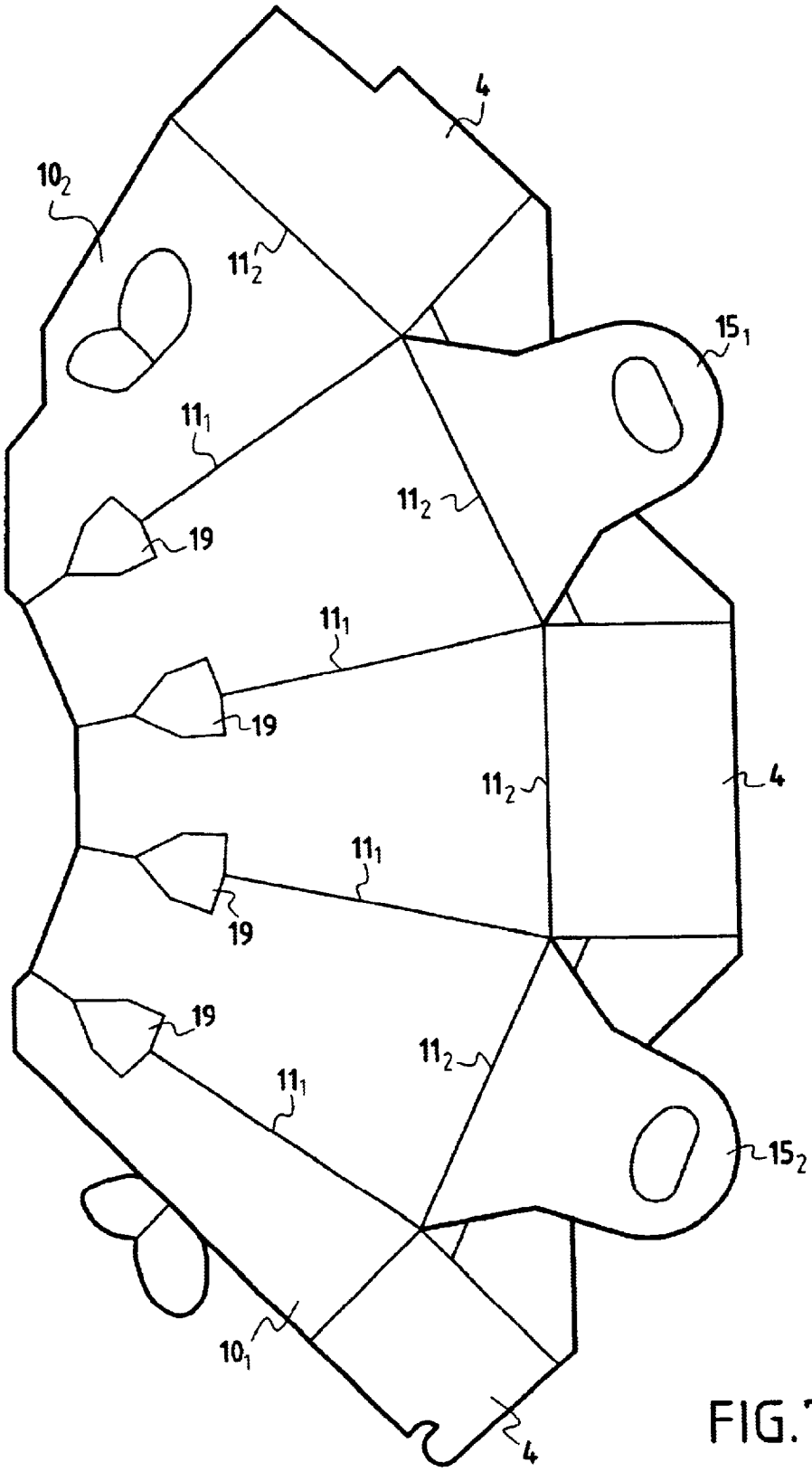

In FIGS. 4 and 7, the sheet constituting the shell has fold lines $11_2$ in its upper portion that are perpendicular to said first fold lines $11_1$ which define said upper funnel $3_2$ obtained by folding along said first fold lines $11_1$ and it also has in its upper portion said zones constituting the cover 4 and said handle.

The bottom and the opening of the vase have the same square shape and the same dimensions, and said funnels $3_1$, $3_2$ and $2_1$ are of pyramid shape.

Figure 8:
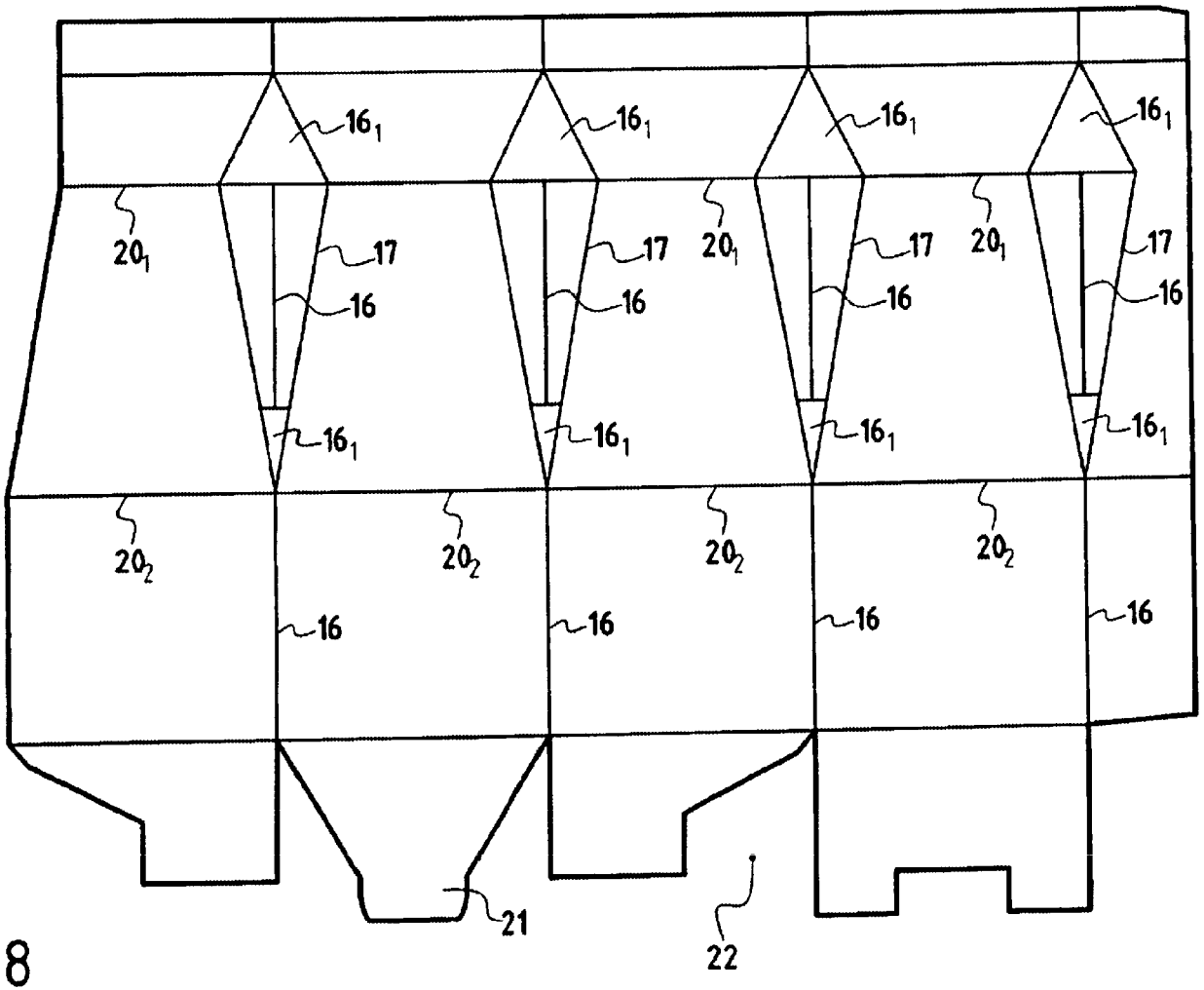
Figure 9:
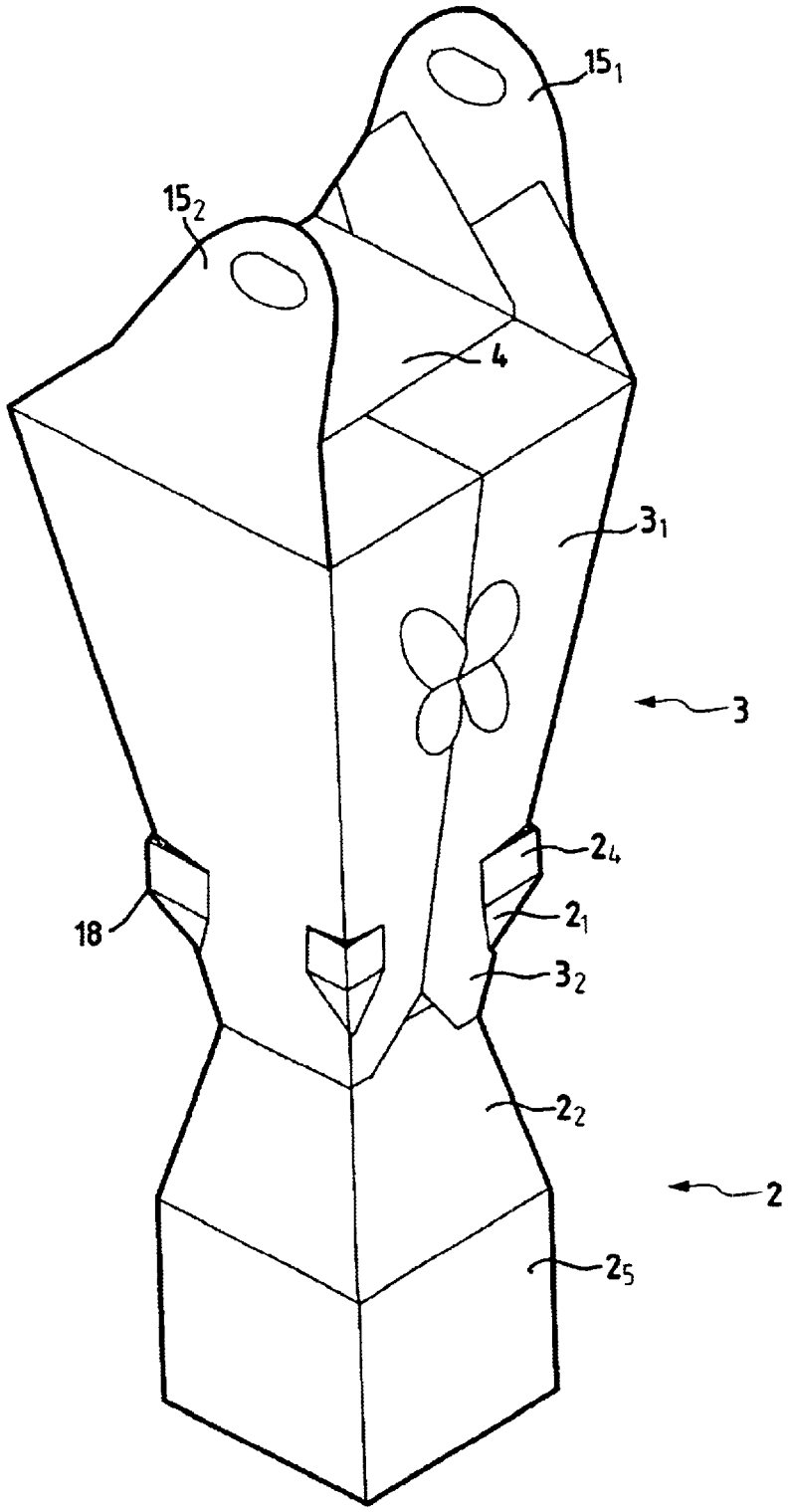

Embodiment 3 (FIGS. 7 to 9)

In this third embodiment as shown in FIGS. 7 to 9, the vase reproduces the main characteristics of the design of the second embodiment, except that its waist is raised as high as possible (to about fourth-fifths of its height above its bottom), thus making it possible to leave a horizontal parallelepipedal pediment having a height of only about 1 cm to 2 cm around the top perimeter thereof, with each corner thereof constituting a cardboard tip that is used for securing the vase to the shell.

In this version of the vase, the bellows enabling the section of the case at waist height to be narrowed are simpler since they are constituted by single reentrant bellows panels obtained by folding along non-parallel fold lines 16 and 17 between two triangular-shaped openings $16_1$.

As in the preceding embodiment, the upper shell is made up of a sheet of transparent plastics material that is scored, cut out, and not stuck together. As in the preceding embodiment, the folds $11_1$ of the main faces are mutually oblique so as to be able to provide a flared funnel shape for the shell.

The shell is constituted by a single funnel shape instead of two funnels having different inclinations, as was the case in the preceding embodiment.

In addition, the bottom end of the shell no longer has any hooks for securing the bottom of the shell to the vase, instead it has openings 19 formed symmetrically at the bottom of each of the sloping folds $11_1$. These openings are used when the shell is wrapped around the vase so as to allow the corners of the top parallelepipedal portion of the vase to project thorough the cutouts in the shell, thereby securing the shell on the vase.

In order to avoid having edges juxtaposed against each other in a main face, the side panels $10_1$ and $10_2$ are overlapped by a few centimeters before being locked together by the butterfly wings $8_2$, $8_3$.

What is claimed is:

1. A display and packaging unit comprising:

a plurality of packages for holding bunches of fresh-cut flowers, each of said flowers having a flowering end and an opposed cut end, each of said plurality of packages including:

a quasi-rigid shell having a lower portion and an upper funnel-shaped portion surrounding at least said flowering, ends of said flowers a top of said upper portion having an opening therein;

a leakproof and rigid vase having an upper portion and a bottom portion, said upper portion of said vase being configured to mate with said lower portion of said shell, and said bottom portion of said vase being adapted to contain at least one of a liquid and a gel for hydrating said cut ends of said flowers;

connection means for removably connecting said shell to said vase, said connection means including an opening disposed on one of the upper portion of the vase and the lower portion of the shell, and a hook disposed on the other of the upper portion of the vase and the lower portion of the shell, said hook being positioned to engage said opening and thereby connect the upper portion of the vase and the lower portion of the shell;

a cover connected to said top of said upper portion of said shell, and adapted to close said opening therein, to protect said flowering ends of said flowers;

at least one lateral opening/closing means in said upper portion of said shell, for permitting the opening and closing of said upper funnel-shaped portion of said shell; and a stand having a second plurality of sockets therein, said second plurality being no less than said first plurality, each of said second plurality of sockets having an inner surface suitable for co-operating with a bottom portion of one of said vases, said second plurality of sockets being arranged so that adjacent ones of said second plurality of sockets are spaced from each other at a distance and an orientation sufficient to permit said covers of said shells of said packages disposed in said adjacent sockets to bear against one another.

2. A package for bunches of fresh-cut flowers, the package comprising a quasi-rigid shell having an upper portion and lower portion, and surrounding at least the flowering ends of said flowers and including a leakproof and rigid vase having an upper portion and lower portion, and being suitable for containing at least one of a liquid and a gel for keeping the cut ends of the stems of said flowers hydrated, and said shell comprises a funnel-shaped portion so that the lower portion of the shell cooperates with the upper portion of the vase via connection means and whose upper portion of the shell surrounds the flowering ends of said flowers; and a cover for protecting said flowering ends, which cover closes the upper portion of the funnel-shaped shell, said shell including in its said upper portion of the shell at least one lateral opening/closing means for opening and closing said shell; wherein the connection means includes an opening disposed on one of the upper portion of the vase and the lower portion of the shell, and a hook disposed on one of the upper portion of the vase and respectively the lower portion of the shell, said hook being positioned to engage said opening and thereby connect the upper portion of the vase and the lower portion of the shell.

3. A package for bunches of fresh-cut flowers, the package comprising a quasi-rigid shell having an upper portion and lower portion, and surrounding at least the flowering ends of said flowers and including a leakproof and rigid vase having an upper portion and a lower portion, and being suitable for containing at least one of a liquid and a gel for keeping the cut ends of the stems of said flowers hydrated, and said shell comprises a funnel-shaped portion so that said lower portion of the shell cooperates with said upper portion of the vase via connection means and said upper portion of the shell surrounds the flowering ends of said flowers; and a cover for protecting said flowering ends, which cover closes the upper portion of the funnel-shaped shell, said upper portion of said shell including at least one lateral opening/closing means for opening and closing said shell; wherein the connection means includes an opening disposed on one of the upper portion of the vase and the lower portion of the shell, and a hook disposed on the other of the upper portion of the vase and the lower portion of the shell, said hook being positioned to engage said opening and thereby connect the upper portion of the vase and the lower portion of the shell.

4. A package for bunches of flowers according to claim 3, wherein the lower portion of the funnel-shaped shell overlies and matches the shape of an upper portion of the vase, which upper portion has the same funnel shape as said lower portion of the shell.

5. A package according to claim 3, wherein said shell is constituted by a precut and non-stuck sheet having nonparallel longitudinal first fold lines suitable for obtaining a funnel shape of polygonal section after folding.

6. A package according to claim 5, wherein said at least one lateral opening/closing means of said shell is constituted by hook and notch shaped cutouts on the side edges in the upper portion of the shell located above the vase.

7. A package according to claim 3, wherein said upper portion of said shell includes an upper funnel having sides and a central axis, and said lower portion thereof includes a lower funnel having sides and a central axis co-axial with said central axis of said upper funnel, the sides of the upper funnel sloping relative to said central axis thereof at an angle that is smaller than the angle at which the sides of the lower funnel slope relative to the central axis of the upper and lower funnels, said lower funnel of the shell overlying said upper portion of the vase.

8. A package according to claim 3, wherein said vase is constituted by a sheet having parallel longitudinal first fold lines enabling the following to be formed by folding from top to bottom:

a top opening of the vase;

an upper first funnel-shaped portion of polygonal section with the sides of the polygon narrowing downwards;

a lower second funnel-shaped portion of polygonal section with the sides of the polygon of said polygonal section widening downwards; and a bottom constituting a flat bottom for the vase, said bottom and said top opening of the vase thus having the same polygonal shape.

9. A package according to claim 8, wherein said vase has a top first parallelepipedal portion defined by second fold lines perpendicular to said parallel fold lines of said vase, said first parallelpipedal portion being situated above said upper funnel-shaped portion and constituting the top opening of the vase.

10. A package according to claim 8, wherein said vase has a second parallelepipedal portion corresponding to the lower portion of said vase and defined by second fold lines perpendicular to said parallel fold lines, said second parallelepipedal portion being situated beneath said lower second funnel-shaped portion of said vase, and including the bottom of said vase.

11. A package according to claim 3, wherein said cover is constituted by cutting out one or more zones at a top end of a sheet constituting said shell and enabling a top opening of the upper funnel of said shell to be closed after folding.

12. A package according to claim 11, herein said sheet constituting said shell has one or more zones at its top end suitable for constituting a handle after folding.

13. A package according to claim 3, wherein the shell is made of a transparent plastics material.

14. A package according to claim 3, wherein the vase is made of a folded flat sheet having qualities of mechanical resistance to moisture, and including a leakproof inner lining for retaining water that is poured into said vase.

15. A package according to claim 3, the package being made up of two portions respectively constituting a shell and a vase, said shell and vase being suitable for being folded into a flat shape prior to use.

16. A package according to claim 3, wherein the connection means includes an opening disposed on one of the upper portion of the shell and the lower portion of the shell, and a hook disposed on the other of the upper portion of the shell and the lower portion of the shell, said hook being positioned to engage said opening and thereby connect the upper and lower portions of the shell.

17. A package according to claim 3 wherein said shell comprises a precut and non-stick sheet having nonparallel longitudinal first fold lines suitable for obtaining a funnel shape of polygonal section after folding; and wherein said connection means between the shell and the vase comprise openings in the lower portion of the shell along said nonparallel longitudinal first fold lines of the shell, and hooking means consisting of projecting elements at corners of the upper portion of the vase in the form of a polygonal funnel, said projecting elements penetrating into said openings of the shell after the shell has been folded around the vase and said at least one lateral opening/closing means of said shell have been operated to close said connection of said shell and said vase.

* * * * *